US005458738A

United States Patent [19]

Chamblee et al.

[11] Patent Number: 5,458,738

[45] Date of Patent: Oct. 17, 1995

[54] CLARIFYING SUSPENDED SOLIDS FROM LIQUID PROCESS STREAMS

[75] Inventors: J. Wayne Chamblee; Brian F. Greenwood; Louis O. Torregrossa, all of Queensbury; Gunther Plattner, South Glens Falls, all of N.Y.

[73] Assignee: Kamyr, Inc., Glens Falls, N.Y.

[21] Appl. No.: 117,592

[22] Filed: Sep. 8, 1993

[51] Int. Cl.[6] ..... D21F 1/66

[52] U.S. Cl. ..... 162/190; 210/221.2; 210/512.1; 210/787; 210/703; 209/166; 209/170; 209/725; 209/730

[58] Field of Search ..... 209/164, 166, 209/170, 156, 157, 724, 725, 730; 210/221.2, 512.1, 787, 703, 928; 162/190, 55, 57

[56] References Cited

U.S. PATENT DOCUMENTS 4,279,743 7/1981 Miller ..... 209/211
4,838,434 6/1989 Miller et al. ..... 209/211
5,022,983 6/1991 Myers ..... 205/166
5,069,751 12/1991 Chamblee et al. .
5,116,488 5/1992 Torregrossa .
5,131,980 7/1992 Chamblee et al. .

*Primary Examiner*—Brenda Adele Lamb
*Attorney, Agent, or Firm*—Nixon & Vanderhye

[57] ABSTRACT

Liquid process streams—such as white water, pressate, or washer filtrate from a pulp and paper mill— are clarified in an efficient manner using a gas sparged hydrocyclone, which takes up a minimum of floor space. A liquid stream having a consistency of less than about 0.5% solids is introduced into a first end of a vortex. Gas is sparged into the liquid in the vortex to cause particles to attach to gas bubbles and move through a rejects outlet at the first end of the vortex, while clarified liquid is removed from a second end of the vortex. A pedestal is typically provided at the accepts outlet, having a radial clearance with the inside of a porous tube through which the gas is sparged that is about 8–12% the radius of the porous tube.

20 Claims, 1 Drawing Sheet

CLARIFYING SUSPENDED SOLIDS FROM LIQUID PROCESS STREAMS

BACKGROUND AND SUMMARY OF THE INVENTION

There are many circumstances in which liquid process streams, used in industrial processes, become contaminated to an extent that it hinders their reuse. If this occurs, it is desirable to be able to clarify the streams in a quick and effective manner. However, since the equipment space is at a premium in many installations, clarifying techniques such as settling tanks or ponds are not always practical.

According to the present invention, it has been recognized that equipment like that used in the deinking of paper during recycling, and/or removing sticky contaminants, such as shown in U.S. Pat. Nos. 5,069,751 and 5,131,980 (the disclosures of which are hereby incorporated by reference herein) can successfully be employed to clarify liquid process streams, with only minor modifications. That is, according to the invention, it has been found that by using a compact gas sparged hydrocyclone on liquid streams having a solids consistency of less than about 0.5% (and more than 90% of the particles having a maximum dimension of less than 500 microns) it is possible to quickly and effectively clarify the liquid stream, e.g. to remove at least 60–70% of the suspended particles in the stream having a size between 10–200 microns, or between just above 0 and 150 microns.

The invention is particularly applicable to liquid process streams from pulp and paper mills, such as white water, pressate, or washer filtrate. White water is that water drained from a paper machine during the process of converting paper machine headbox feedstock into paper or market pulp. This water typically contains suspended solids such as conventional fillers (e.g. clays, calcium carbonate, etc.) used in the paper making operation as well as fibers which were not retained with the paper sheet formed. Washer filtrate is the liquid obtained as stock is thickened or washed. In a recycled fiber application, it can contain suspended solids such as inks and paper fillers and coating in addition to fibers not retained by the washer mat. The invention is particularly successful in clarifying these liquids in a highly efficient manner, while the equipment takes up little space.

The hydrocyclone used according to the invention is basically as shown in U.S. Pat. Nos. 5,069,751 and 5,131,980, and includes an inlet, rejects outlet, accepts outlet, a porous tube having a given internal radius and through which gas may be sparged, and a pedestal adjacent the accepts outlet and defining a clearance space. The porous tube may have a nominal diameter of about 2–15 inches. While in a typical deinking application the clearance is about 15% of the inner radius, when practicing the liquid clarifying method according to the present invention, the clearance is about 8–12% (e.g. about 10%) of the inner radius.

According to one aspect of the present invention there is provided a method of clarifying a liquid stream containing suspended solid particles, the stream having a solids consistency of less than about 0.5%, and more than 90% of the particles having a maximum dimension of less than 500 microns. The method comprises the steps of substantially sequentially and continuously: (a) introducing the liquid stream having a consistency of less than about 0.5% into a first end of a vortex; (b) sparging gas into the suspension in the vortex to cause particles to attach to gas bubbles and move back toward the first end of the vortex, while the majority of the liquid stream moves toward a second end of the vortex, opposite the first end; (c) removing the clarified stream from the second end of the vortex in an accepts stream, the accepts stream having a greatly reduced particles content compared to the liquid stream at the first end of the vortex; and (d) removing particles attached to gas bubbles from the first end of the vortex in a rejects stream.

The method is particularly useful where the liquid stream is a pulp and paper mill process stream, and it comprises the further step of (e) using the clarified liquid from step (d) in a pulp and paper mill process. Step (e) is preferably practiced immediately after step (d), without further treatment of the liquid in the stream.

The method may also comprise the further step of (e) adding surface charge modifying chemical to the liquid stream prior to, or during, the practiced of steps (a)–(c), to modify the surface charge of the particles in the liquid, e.g. by adding anionic, nonionic or cationic surfactant mixtures of the type currently used in dissolved air clarification or wastepaper flotation. The liquid may be a process liquid from a pulp and paper mill process stream, and has some cellulose fibers and/or filler therein; and step (e) may be practiced to alter the quantity of fiber and/or fillers in the accepts stream of step (c).

Step (a) may be practiced at conditions comparable to a feed pressure of about 15 psig and a flow rate of about 27 GPM, with the vortex having a diameter of about 2 inches, with step (b) practiced at a gas flow rate of about 4–5 scfm, and step (d) practiced to provide a rejects flow rate of about 1–2 GPM.

The method is preferably practiced using a hydrocyclone having an inlet, a rejects outlet, an accepts outlet, a porous tube of given radius through which the gas of step (b) is sparged, and a pedestal adjacent the accepts outlet and defining a clearance space; and there is preferably the further step of adjusting the clearance space so that it is in the range of about 8–12% of the porous tube given radius.

According to another aspect of the invention, a method of clarifying and utilizing a liquid stream selected from the group consisting essentially of white water, pressate, and washer filtrate from a pulp and paper mill, using a hydrocyclone having an inlet, rejects outlet, accepts outlet, a porous tube having a given internal radius and through which gas may be sparged, and a pedestal adjacent the accepts outlet and defining a clearance space, is provided. The method comprises the steps of: (a) adjusting the clearance space so that it is in the range of about 8–12% (e.g. 10%) of the porous tube given radius; then substantially continuously (b) introducing the liquid stream into the inlet; (c) introducing gas through the gas permeable tube; (d) withdrawing rejects from the rejects outlet, and accepts from the accepts outlet; and (e) reusing the accepts directly in the pulp and paper mill as process stream liquid.

It is the primary object of the present invention to provide a method for efficiently clarifying liquid process streams without taking up a substantial amount of space for the clarifying process. This and other objects of the invention will become clear from an inspection of the detailed description of the invention, and from the appended claims.

DETAILED DESCRIPTION OF THE DRAWINGS

Figures 1, 2:
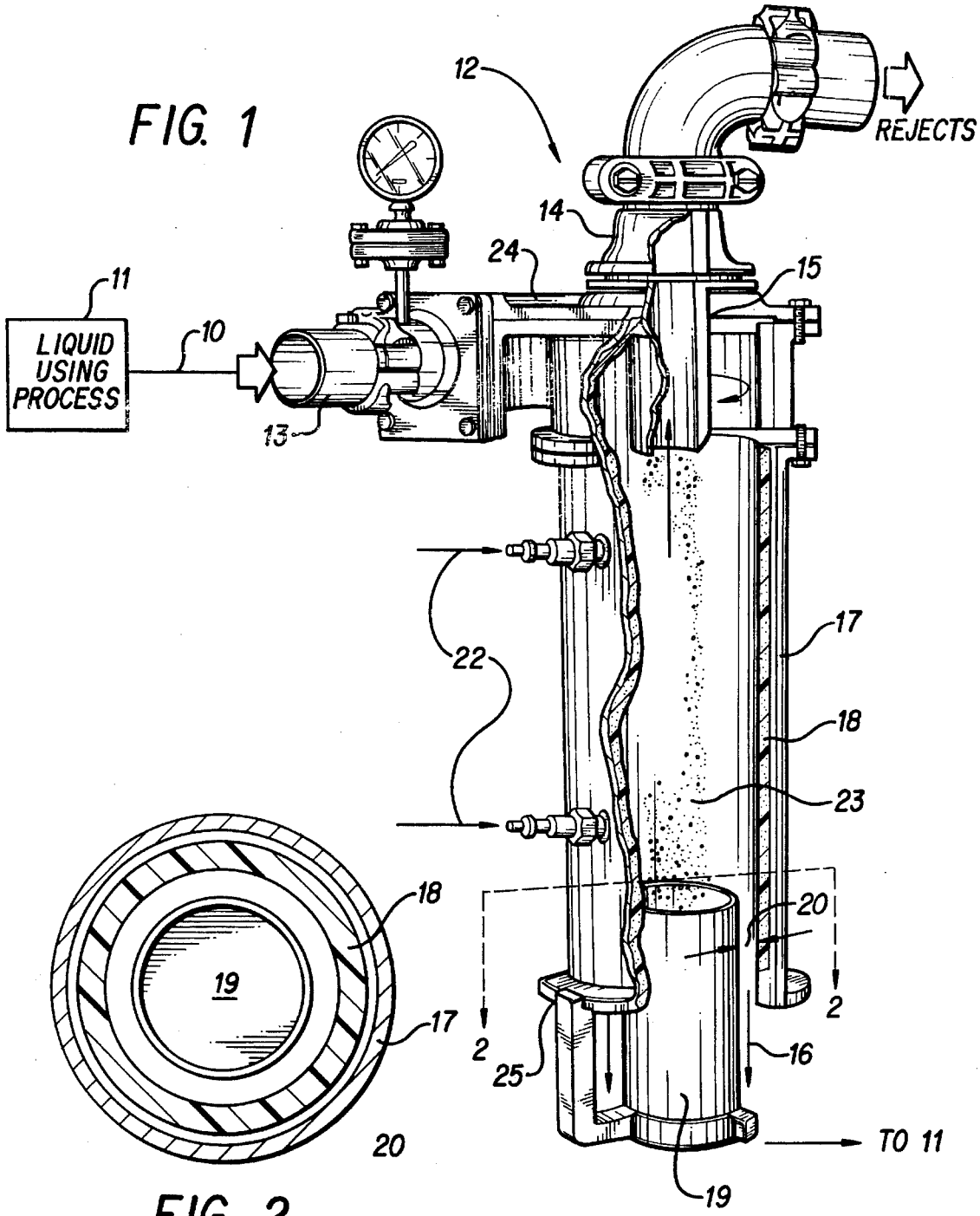
FIG. 1 is a side view, with portions cut away for clarity of illustration, of an exemplary air sparged hydrocyclone that may be used to practice the method of the present invention.
FIG. 2 is a longitudinal cross-sectional view taken along lines 2—2 of FIG. 1.

FIG. 1 schematically illustrates the discharge 10 from a liquid using industrial process 11 being fed to a conventional air sparged hydrocyclone 12, such as shown in U.S. Pat. No. 5,069,751. The process liquid flowing in line 10 may be almost any known process liquid having enough particles suspended therein to require or desirably employ clarification. However the process stream in line 10 will typically have about 0.5% solids, or less, and typically more than 90% of the solids will have a maximum dimension of less than 500 microns. Typical process liquids in line 10 that may be treated according to the invention include white water, pressate, or washer filtrate, from pulp and paper mills, which typically have fibers, suspended ink particles, fillers, and other particles therein.

The hydrocyclone 12 includes an inlet 13 for the liquid to be clarified, a rejects outlet 14 at the top thereof in communication with the interior of the vortex finder 15, an accepts outlet 16 at the bottom thereof, an outer solid-wall housing 17, and a gas permeable (porous) interior tube 18. Typically a pedestal 19, which may be mounted for movement with respect to the housing 17 in a known manner, is provided at the accepts outlet 16, and defines a radial clearance 20 (see FIG. 2) with respect to the porous tube 18 interior wall. In the practice of the present invention, this radial clearance 20 is preferably about 8–12% (e.g. about 10%) of the radius 21 of the porous tube 18. Typically the tube 18 has a nominal two to fifteen inch diameter, i.e. an interior diameter of about two inches. The clearance 20 for a two inch interior diameter tube 18 would thus be about 0.1 inches.

Air, or other gas, is introduced into the housing 18 through one or more nipples 22, the gas then being sparged through the porous tube 18 into the liquid flowing in a vortex within the housing 18. Air sparging causes particles in the liquid stream in the vortex to attach to gas bubbles and move, in the form or a froth (shown schematically at 23 in FIG. 1) back toward the end 24 of the hydrocyclone 12 into which the liquid in line 10 was introduced, the froth 23 passing through the vortex finder 15 into the rejects outlet 14. The majority of the liquid moves toward the second end 25 of the hydrocyclone 12, opposite the end 25, comprising clarified liquid, which passes out the accepts outlet 16 (in the form of an annulus as illustrated in the drawings).

While a pedestal 19 is shown in the drawings, it is to be understood that the pedestal 19 may be replaced by a valve or orifice or like device capable of controlling flow while providing sufficient fluid holdup to maintain the proper pressure differential between the accept (through 16) and reject (through 14) streams. Whatever device is utilized, it preferably provides an increase in pressure differential corresponding to a pedestal clearance 20 having about 50–60% of the clearance size for treating 2% consistency stock during deinking.

When using he hydrocyclone 12 according to the invention, the feed flow rate and pressure, and air flow rate and pressure, are similar to those used in flotation deinking with the hydrocyclone. For example using a 2 inch nominal diameter porous tube 18, the feed pressure of about 15 psig results in a feed flow rate of about 27 GPM; the reject flow rate is about 1–2 GPM at this feed rate when an air flow rate of 4–5 scfm is used.

While at least in pulp and paper mills normal liquid process streams have enough surfactants so that the addition of surfactants are not necessary, if necessary or desirable, surfactant mixtures containing anionic or cationic polymers of the type currently used in the dissolved air clarification of wastewaters could be used, and/or nonionic surfactant mixtures of the type conventionally used for wastepaper flotation. These mixtures would modify the surface charge of solids in the water, and could thus be used to alter the quantity of either or both the amount of fiber and filler in the accept stream (through outlet 16) from the hydrocyclone 12. In some circumstances it is desirable to have some fiber and/or filler in the accept stream since it is necessary during additional contacts with other streams or materials in a paper making process; in such a case the clarification according to the invention is used merely to prevent an excess buildup of dirt, in particles, fibers, and fillers. The surfactants may be added prior to introducing the liquid to the vortex, or while the liquid is in the vortex.

Practicing the clarification method according to the invention, it is possible to remove at least about 60% of the suspended particles having a size between 10–200 microns; or to remove at least about 70% of the particles having a size between just above 0 and 150 microns. Examples of the results obtained according to the invention using a two inch nominal diameter hydrocyclone are set forth in the following Tables I and II, Table I being for the treatment of white water, and Table II for the treatment of washer filtrate.

TABLE I

| Particle Size in Microns | White Water Feed | Accepts Stage 1 | Rejects Stage 1 | Percent Removed by: Stage 1 |
|---|---|---|---|---|
| 00–20 | 920 | 359 | 4259 | 61.0% |
| 20–40 | 715 | 274 | 3086 | 61.7% |
| 40–60 | 1247 | 464 | 5814 | 62.8% |
| 60–80 | 339 | 121 | 1970 | 64.3% |
| 80–100 | 196 | 87 | 1751 | 55.6% |
| 100–140 | 86 | 29 | 1331 | 66.3% |
| 140–180 | 31 | 8 | 682 | 74.2% |
| 180–220 | 8 | 5 | 311 | 37.5% |
| 220–260 | 0 | 4 | 115 | — |
| 260–350 | 3 | 0 | 89 | 100.0% |
| 350–500 | 0 | 0 | 35 | — |
| 500–1000 | 0 | 1 | 8 | — |
| 1000–1500 | 0 | 0 | 0 | — |
| Total | 3534 | 1352 | 19451 | 61.7% |

TABLE II

| Particle Size in Microns | Wash Stg Filtrate Feed Stream | Accepts Stage 1 | Rejects | Percent Removed by: Stage 1 |
|---|---|---|---|---|
| 00–20 | 1403 | 350 | 4114 | 75.1% |
| 20–40 | 1014 | 277 | 2963 | 72.7% |
| 40–60 | 1935 | 500 | 6171 | 74.2% |
| 60–80 | 554 | 122 | 2354 | 78.0% |
| 80–100 | 379 | 77 | 2305 | 79.7% |
| 100–140 | 183 | 40 | 1962 | 78.1% |
| 140–180 | 68 | 22 | 1181 | 67.6% |
| 180–220 | 17 | 7 | 549 | 58.8% |
| 220–260 | 9 | 2 | .3 | 77.8% |
| 260–350 | 4 | 0 | 259 | 100.0% |
| 350–500 | 3 | 1 | 95 | 66.7% |
| 500–1000 | 0 | 0 | 7 | — |
| 1000–1500 | 0 | 0 | 0 | — |
| Total | 5569 | 1398 | 22260 | 74.9% |

The results set forth in Tables I and II have been presented by one of the inventors at the Nov. 3, 1992 Pulping Conference in Boston, Mass.

It will thus be seen that according to the present invention a method of clarifying liquid process streams has been provided that is particularly efficient, and is practiced with equipment taking up a minimum of floor space. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and processes.

What is claimed is:

1. A method of clarifying a liquid stream containing suspended solid particles, the liquid stream comprising a pulp and paper mill process stream, and the liquid stream having a solids consistency of less than about 0.5%, and more than 90% of the particles having a maximum dimension of less than 500 microns, comprising the steps of substantially sequentially and continuously:

(a) introducing the liquid stream having a consistency of less than about 0.5% into a first end of a vortex;

(b) sparging gas into the liquid stream in the vortex to cause particles to attach to gas bubbles and move back toward the first end of the vortex, while the majority of the liquid stream moves toward a second end of the vortex, opposite the first end, to produce a clarified stream;

(c) removing the clarified stream from the second end of the vortex in an accepts stream, the accepts stream having a greatly reduced particles content compared to the liquid stream at the first end of the vortex;

(d) removing the particles attached to the gas bubbles from the first end of the vortex in a rejects stream; and (e) using the accepts stream from step (c) in a pulp and paper mill process.

2. A method as recited in claim 1 wherein step (b) is practiced by introducing the gas through a porous tube having a nominal diameter of between about 2 and 15 inches.

3. A method as recited in claim 1 wherein steps (a)–(d) are practiced to remove at least about 60% of the particles having a size between 10 and 200 microns.

4. A method as recited in claim 1 wherein step (e) is practiced immediately after step (d), without further treatment of the accepts stream.

5. A method as recited in claim 1 wherein the liquid stream is white water, pressate, or washer filtrate.

6. A method as recited in claim 1 comprising adding surface charge modifying chemical to the liquid stream prior to, or during, the practice of steps (a)–(c), to modify the surface charge of the particles in the liquid stream.

7. A method as recited in claim 6 wherein the liquid stream from the pulp and paper mill process stream, has some cellulose fibers therein; and wherein step (e) is practiced to alter the quantity of the cellulose fibers in the accepts stream of step (c).

8. A method as recited in claim 7 wherein the pulp and paper mill process stream has a substantial quantity of filler therein, and wherein step (e) is further practiced to alter the quantity of filler in the accepts stream of step (c).

9. A method as recited in claim 8 wherein said method is practiced using a hydrocyclone having an inlet, a rejects outlet, an accepts outlet, a porous tube of given radius through which the gas of step (b) is sparged, and a pedestal adjacent the accepts outlet and defining a clearance space; and comprising the further step of adjusting the clearance space so that it is in the range of about 8–12% of the porous tube given radius.

10. A method as recited in claim 1 wherein step (a) is practiced at conditions in which the liquid stream has a feed pressure of about 15 psig and a flow rate of about 27 GPM, wherein the vortex has a diameter of about 2 inches, and wherein step (b) is practiced at a gas flow rate of about 4–5 scfm, and wherein step (d) is practiced to provide a rejects flow rate of about 1–2 GPM.

11. A method as recited in claim 1 wherein steps (a)–(d) are practiced to remove at least 70% of the particles having a size between just above 0 and 150 microns.

12. A method as recited in claim 1 wherein said method is practiced using a hydrocyclone having an inlet, a rejects outlet, an accepts outlet, a porous tube of given radius through which the gas of step (b) is sparged, and a pedestal adjacent the accepts outlet and defining a clearance space; and comprising the further step of adjusting the clearance space so that it is in the range of about 8–12% of the porous tube given radius.

13. A method as recited in claim 1 comprising the further step of, just prior to or simultaneously with step (a), adding anionic, cationic, or nonionic surfactant mixtures to the liquid stream.

14. A method of clarifying and utilizing a liquid stream selected from the group consisting essentially of white water, pressate, and washer filtrate from a pulp and paper mill, using a hydrocyclone having an inlet, rejects outlet, accepts outlet, a porous tube having a given internal radius and through which gas may be sparged, and a pedestal adjacent the accepts outlet and defining a clearance space, comprising the steps of:

(a) adjusting the clearance space so that it is in the range of about 8–12% of the porous tube given radius; then substantially continuously (b) introducing the liquid stream into the inlet;

(c) introducing the gas through the porous tube;

(d) withdrawing rejects from the rejects outlet, and accepts from the accepts outlet; and (e) reusing the accepts directly in the pulp and paper mill as process stream liquid.

15. A method as recited in claim 14 wherein step (e) is practiced to use the accepts without further treatment in the same liquid stream from which it was taken.

16. A method as recited in claim 14 wherein step (b) is practiced at conditions in which the liquid stream has a flow rate of about 27 GPM, and a pressure of about 15 psig, wherein the nominal diameter of the vortex is about 2 inches, and wherein step (c) is practiced at a gas flow rate of about 4–5 scfm, and wherein step (d) is practiced to withdraw the rejects at a rate of about 1–2 GPM.

17. A method as recited in claim 14 comprising the further step of (f) adding surface charge modifying chemical to the liquid stream prior to, or during, the practice of steps (b)–(e), to modify the surface charge of the particles in the liquid stream.

18. A method as recited in claim 17 wherein the liquid stream has some cellulose fibers and filler therein; and wherein step (f) is practiced to alter the quantity of the filler and/or the cellulose fibers in the accepts of step (d).

19. A method as recited in claim 14 wherein step (a) is practiced so that the clearance space is about 10% of the porous tube given radius.

20. A method as recited in claim 14 wherein steps (a)–(d) are practiced to remove at least about 60% of the particles having a size between 10 and 200 microns.

* * * * *